US010721989B2

(12) United States Patent
Jenkins et al.

(10) Patent No.: US 10,721,989 B2
(45) Date of Patent: Jul. 28, 2020

(54) KNIT SHOE UPPER WITH MOC SEAM AND COLLAR

(71) Applicant: Cole Haan LLC, New York, NY (US)

(72) Inventors: Kyle Jenkins, Greenland, NH (US); Joseph Benedetto, Greenland, NH (US)

(73) Assignee: COLE HAAN LLC, New York, NY (US)

( * ) Notice: Subject to any disclaimer, the term of this patent is extended or adjusted under 35 U.S.C. 154(b) by 99 days.

(21) Appl. No.: 15/994,727

(22) Filed: May 31, 2018

(65) Prior Publication Data

US 2019/0365012 A1 Dec. 5, 2019

(51) Int. Cl.

| | |
|---|---|
| ***A43B 3/14*** | (2006.01) |
| ***A43B 1/04*** | (2006.01) |
| ***A43B 3/10*** | (2006.01) |
| ***A43B 23/26*** | (2006.01) |
| ***A43B 13/28*** | (2006.01) |
| ***A43B 23/02*** | (2006.01) |
| ***A43B 13/14*** | (2006.01) |

(52) U.S. Cl.

CPC ..... *A43B 1/04* (2013.01); *A43B 3/10* (2013.01); *A43B 3/14* (2013.01); *A43B 13/14* (2013.01); *A43B 13/28* (2013.01); *A43B 23/025* (2013.01); *A43B 23/26* (2013.01)

(58) Field of Classification Search

CPC .... A43B 1/00; A43B 1/04; A43B 3/14; A43B 23/0205; A43B 23/025; A43B 23/04; A43B 23/042

USPC ..... 36/11, 9 R, 45, 47, 48, 49, 57, 58

See application file for complete search history.

(56) References Cited

U.S. PATENT DOCUMENTS

| | | | | | |
|---|---|---|---|---|---|
| 1,139,153 | A * | 5/1915 | Bass | A43B 3/14 | 36/11 |
| 1,871,763 | A * | 8/1932 | Wiggin | A43B 3/14 | 36/11 |
| 2,168,948 | A * | 8/1939 | Allen, Jr. | A43B 7/12 | 36/57 |
| 2,237,181 | A * | 4/1941 | Hosker | A43B 3/10 | 36/45 |
| 2,934,839 | A * | 5/1960 | Servin | A43B 1/04 | 36/9 R |
| 3,471,948 | A * | 10/1969 | Nadler | A43B 3/14 | 36/11 |
| 3,496,655 | A * | 2/1970 | Clifton | A43B 23/025 | 36/45 |
| 3,793,748 | A * | 2/1974 | Pursley | A43B 1/02 | 36/9 R |
| 3,866,443 | A * | 2/1975 | Hunneke | D04B 21/02 | 66/194 |

(Continued)

*Primary Examiner* — Marie D Bays
(74) *Attorney, Agent, or Firm* — Thompson Coburn LLP

(57) ABSTRACT

A shoe includes a sole and upper secured to the sole. The upper has a knitted element formed of unitary one-piece construction on a knitting machine. The knitted element includes a Moc seam allowance within a toe region, lateral and medial metatarsal regions, and lateral and medial ball regions. The upper has a Moc seam formed in part by the knitted element. The Moc seam is in at least the toe region, the lateral metatarsal region, and the medial metatarsal region. The Moc seam includes a core around which the Moc seam allowance is wrapped and stitched to itself to contain the core at least partially within a cavity formed by the Moc seam allowance.

15 Claims, 4 Drawing Sheets

(56) References Cited

U.S. PATENT DOCUMENTS

| | | | | | |
|---|---|---|---|---|---|
| 4,501,076 | A * | 2/1985 | Dodds | A43B 3/14 | 12/142 MC |
| RE33,018 | E * | 8/1989 | Ostrander | A43B 3/108 | 36/102 |
| 5,384,970 | A * | 1/1995 | Melton | A43B 3/101 | 36/45 |
| 5,678,325 | A * | 10/1997 | Davidowitz | A43C 1/06 | 36/11 |
| 2002/0056502 | A1* | 5/2002 | Bordes | A41D 27/245 | 156/73.4 |
| 2003/0070319 | A1* | 4/2003 | Minden | A43B 3/108 | 36/8.3 |
| 2003/0106171 | A1* | 6/2003 | Issler | A43B 3/14 | 12/142 MC |
| 2008/0230140 | A1* | 9/2008 | Santens | D03D 15/00 | 139/396 |
| 2013/0042380 | A1* | 2/2013 | Goodman | A41D 31/12 | 2/69 |
| 2014/0237861 | A1* | 8/2014 | Podhajny | D04B 1/123 | 36/9 R |
| 2017/0079367 | A1* | 3/2017 | Dua | A43B 1/04 | |

* cited by examiner

KNIT SHOE UPPER WITH MOC SEAM AND COLLAR

CROSS-REFERENCE TO RELATED APPLICATIONS

Not Applicable.

STATEMENT REGARDING FEDERALLY SPONSORED RESEARCH OR DEVELOPMENT

Not Applicable.

APPENDIX

Not Applicable.

BACKGROUND OF THE DISCLOSURE

This disclosure pertains to shoes having knit uppers.

SUMMARY

One aspect of the disclosure pertains to a shoe having a sole and an upper. The upper is secured to the sole, and the upper has a knitted element being formed of a unitary one-piece construction during a knitting process on a knitting machine. The knitted element has a toe end, a heel end, a heel region, a lateral quarter region, a medial quarter region, a lateral midfoot region, a medial midfoot region, a lateral ball region, a medial ball region, a lateral metatarsal region, a medial metatarsal region, a toe region, a tongue region, and a collar region. The heel region extends longitudinally from the heel end to the lateral and medial quarter regions. The lateral and medial quarter regions extend longitudinally from the heel region to the lateral and medial midfoot regions respectively. The lateral and medial midfoot regions extend longitudinally from the lateral and medial quarter regions to the lateral and medial ball regions respectively. The lateral and medial ball regions extend longitudinally from the lateral and medial midfoot regions to the lateral and medial metatarsal regions respectively. The lateral and medial metatarsal regions extend longitudinally from the lateral and medial ball regions to the toe region. The toe region extends longitudinally from the lateral and medial metatarsal regions to the toe end. The tongue region extends upwardly and laterally from both the lateral and medial ball regions. The collar region extends upwardly from the heel region, lateral and medial quarter regions, and the lateral and medial midfoot regions. The knitted element defines an opening in the collar region. The opening is adapted and configured to receive a foot. The knitted element includes a Moc seam allowance of additional material within the toe region, lateral and medial metatarsal regions, and the lateral and medial ball regions. The upper further has a Moc seam formed in part by the knitted element. The Moc seam is in at least the toe region, the lateral metatarsal region, and the medial metatarsal region. The Moc seam includes a core around which the Moc seam allowance of additional material in the knitted element is wrapped and stitched to itself to contain the core at least partially within a cavity formed by the Moc seam allowance of additional material.

Another aspect of the disclosure pertains to a shoe having a sole and an upper. The upper is secured to the sole, and the upper has a knitted element being formed of a unitary one-piece construction during a knitting process on a knitting machine. The knitted element has a toe end, a heel end, a heel region, a lateral quarter region, a medial quarter region, a lateral midfoot region, a medial midfoot region, a lateral ball region, a medial ball region, a lateral metatarsal region, a medial metatarsal region, a toe region, a tongue region, and a collar region. The heel region extends longitudinally from the heel end to the lateral and medial quarter regions. The lateral and medial quarter regions extend longitudinally from the heel region to the lateral and medial midfoot regions respectively. The lateral and medial midfoot regions extend longitudinally from the lateral and medial quarter regions to the lateral and medial ball regions respectively. The lateral and medial ball regions extend longitudinally from the lateral and medial midfoot regions to the lateral and medial metatarsal regions respectively. The lateral and medial metatarsal regions extend longitudinally from the lateral and medial ball regions to the toe region. The toe region extends longitudinally from the lateral and medial metatarsal regions to the toe end. The tongue region extends upwardly and laterally from both the lateral and medial ball regions. The collar region extends upwardly from the heel region, lateral and medial quarter regions, and the lateral and medial midfoot regions. The knitted element defines an opening in the collar region. The knitted element forms a collar in the collar margin. The collar includes a portion of the knitted element being folded over onto itself and stitched to itself to form two layers. The knitted element extends within the collar margin such that were the knitted element not folded over onto itself, the knitted element would overlap one or more of the lateral midfoot region and the medial midfoot region.

Another aspect of the disclosure pertains to a method of constructing a shoe. The method includes knitting a one-piece knitted element having a unitary one-piece construction using a flat knitting machine. The knitted element has a top side and a bottom side. The knitted element has a toe end, a heel region, a lateral quarter region, a medial quarter region, a lateral midfoot region, a medial midfoot region, a lateral ball region, a medial ball region, a lateral metatarsal region, a medial metatarsal region, a toe region, a tongue region, and a collar region. The toe region extends longitudinally from the toe end, the lateral and medial metatarsal regions extend laterally and longitudinally from the toe region, and the lateral and medial ball regions extending longitudinally and laterally from the lateral and medial metatarsal regions respectively. One or more of the medial and lateral midfoot regions extend longitudinally from one or more of the medial and lateral ball regions. The lateral and medial quarter regions extend longitudinally from the lateral and medial midfoot regions respectively, and the heel region extends longitudinally from one or more of the lateral and medial quarter regions. The tongue region extends laterally and longitudinally and is between the toe region, the lateral metatarsal region, the medial metatarsal region, the lateral ball region, and the medial ball region. The collar region extends laterally from the heel region, lateral and medial quarter regions, and the lateral and medial midfoot regions. The one-piece knitted element is knit with a Moc seam allowance of additional material in the toe region, the lateral and medial metatarsal regions, and the lateral and medial ball regions. The method further includes positioning a core in contact with the knitted element adjacent the Moc seam allowance, drawing the Moc seam allowance at least partially around the core, and stitching the Moc seam allowance to itself such that the core is contained at least partially within a cavity formed by the Moc seam allowance and such that a Moc seam is formed in the knitted element.

Another aspect of the present disclosure pertains to a method for constructing a shoe. The method includes knitting a one-piece knitted element having a unitary one-piece construction using a flat knitting machine. The knitted element has a top side and a bottom side. The knitted element has a toe end, a heel region, a lateral quarter region, a medial quarter region, a lateral midfoot region, a medial midfoot region, a lateral ball region, a medial ball region, a lateral metatarsal region, a medial metatarsal region, a toe region, a tongue region, and a collar region. The toe region extends longitudinally from the toe end, the lateral and medial metatarsal regions extend laterally and longitudinally from the toe region, and the lateral and medial ball regions extending longitudinally and laterally from the lateral and medial metatarsal regions respectively. One or more of the medial and lateral midfoot regions extend longitudinally from one or more of the medial and lateral ball regions. The lateral and medial quarter regions extend longitudinally from the lateral and medial midfoot regions respectively, and the heel region extends longitudinally from one or more of the lateral and medial quarter regions. The tongue region extends laterally and longitudinally and is between the toe region, the lateral metatarsal region, the medial metatarsal region, the lateral ball region, and the medial ball region. The collar region extends laterally from the heel region, lateral and medial quarter regions, and the lateral and medial midfoot regions. The collar region is knit such that a portion of the collar region is positioned underneath a portion of one or more of the lateral midfoot region, the medial midfoot region, and the tongue region. The method further includes folding the collar region of the knitted element over and onto itself to place the collar region in a double layer configuration. In the double layer configuration, a portion of the top side of the collar region is in contact with another portion of the top side of the collar region and a portion of the bottom side of the collar region is on top. The method further includes stitching the folded collar region to itself to secure the collar region in the double layered configuration such that the collar region does not overlap at least the tongue region.

Further features and advantages, as well as the operation, are described in detail below with reference to the accompanying drawings.

Figure 1:
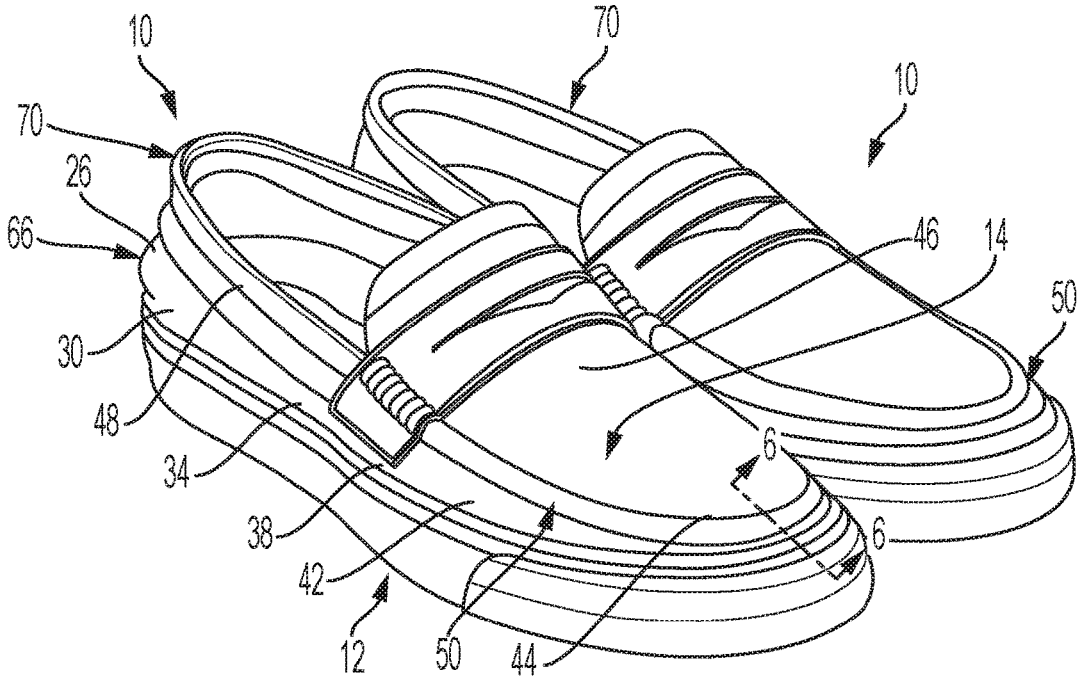
FIG. 1 is a perspective view of an exemplary embodiment of a left shoe and a right shoe of the present disclosure.

Reference numerals in the written specification and in the figures indicate corresponding items.

DETAILED DESCRIPTION

Figure 2:
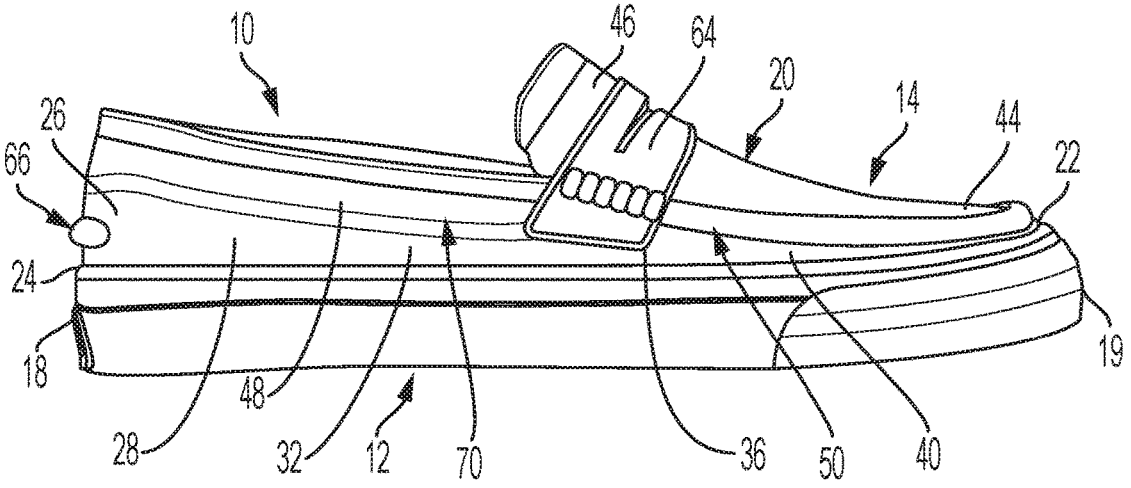
FIG. 2 is a lateral elevation view of the right shoe of FIG. 1.
Figure 3:
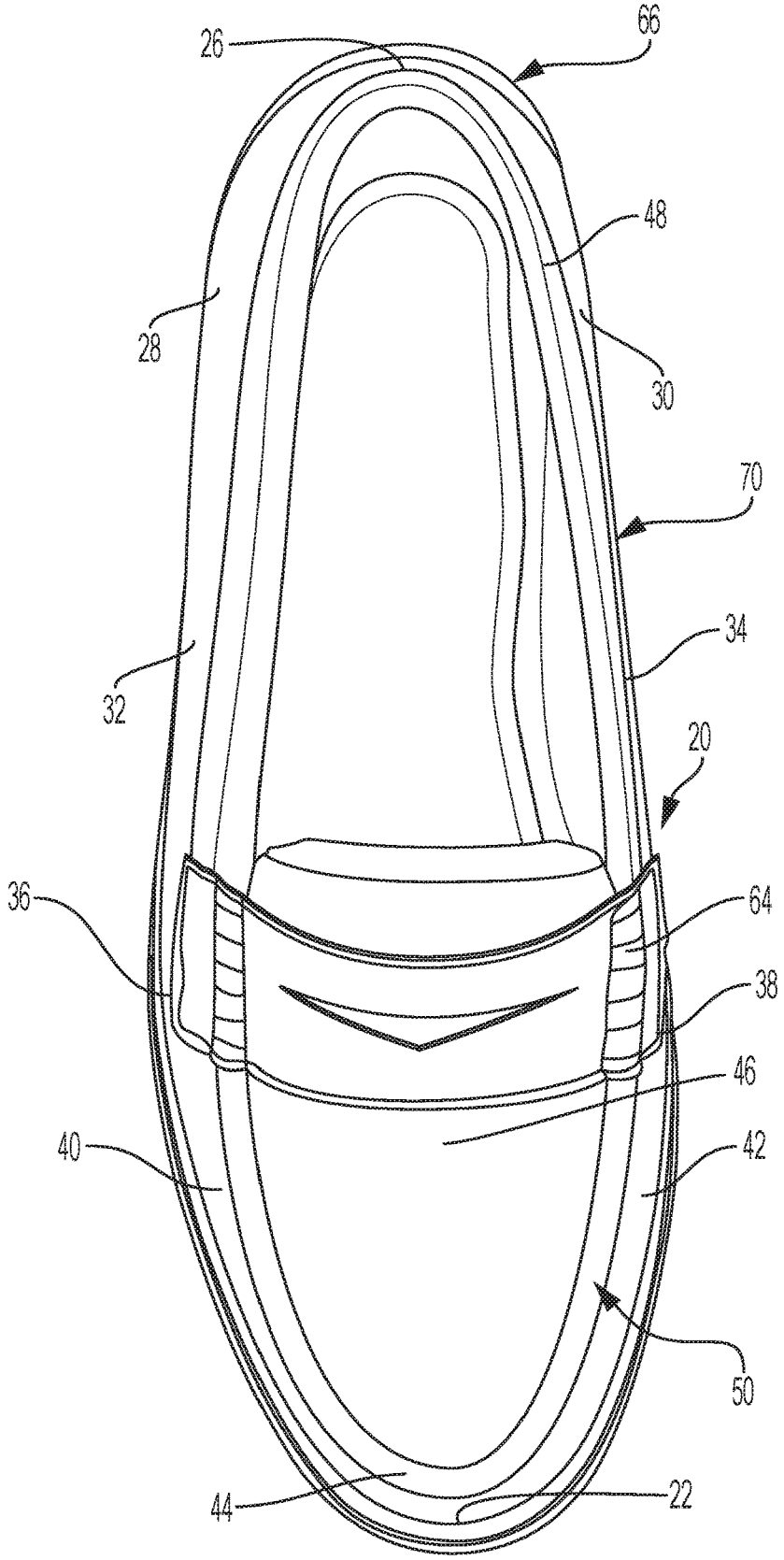
FIG. 3 is a top view of the shoe of FIG. 2.

An embodiment of a shoe in accordance with the present disclosure is indicated by reference numeral 10. The shoe 10 includes a sole, generally indicated at 12, and a knit upper, generally indicated at 14. The sole 12 is secured to the upper 14. For example, and without limitation, the upper 14 is stitched, glued, or otherwise suitably secured to the sole 12. The shoe 10 extends forward from a heel end 18 to a toe end 19. The knit upper 14 has a knitted element 20. The knitted element 20 is shown alone in FIGS. 4 and 5 and shown as part of the assembled shoe in FIGS. 1-3.

Figure 4:
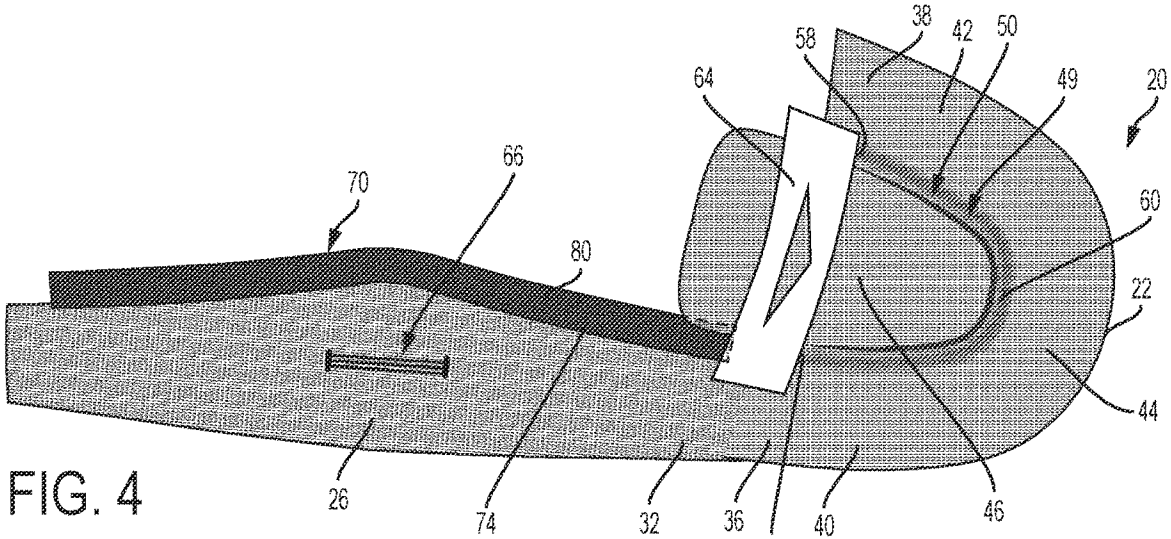
FIG. 4 is a top view of a knit upper of the shoe of FIG. 2.
Figure 5:
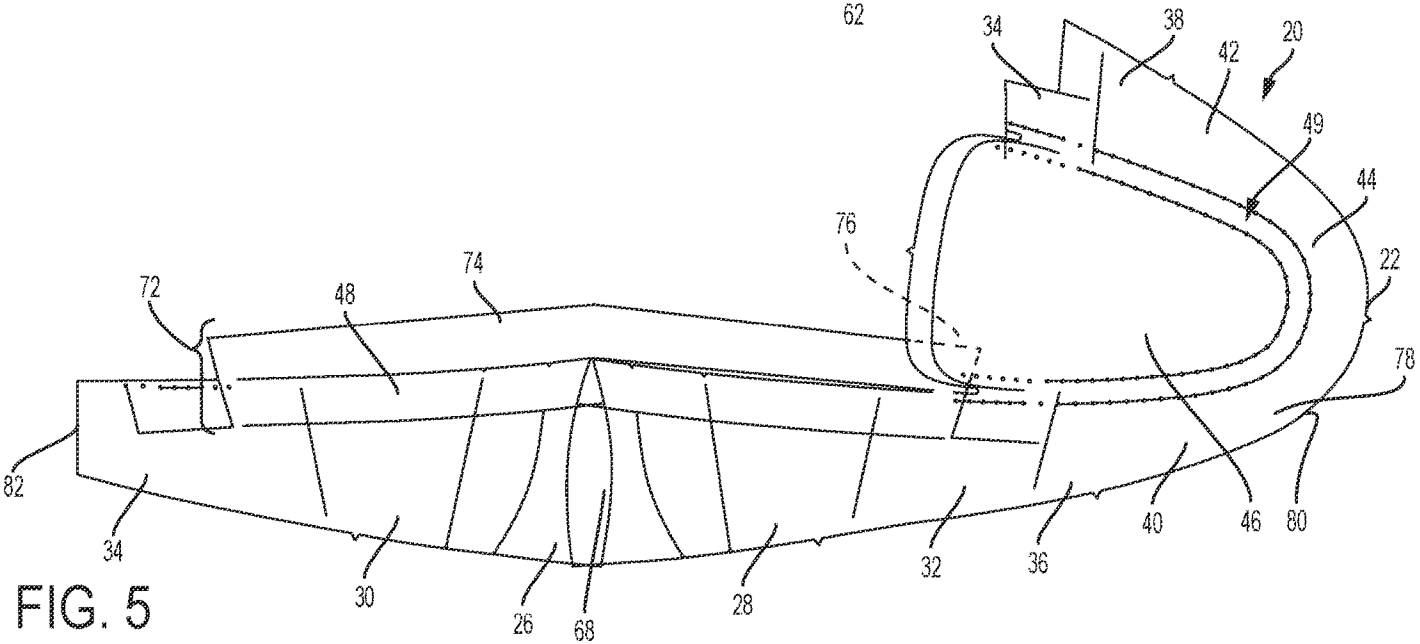
FIG. 5 is a top schematic view of the upper shown in FIG. 4.

The knitted element 20 is formed of a unitary one-piece construction during a knitting process on a knitting machine (not shown). For example, and without limitation, the knitting machine is a type suitable for flat knitting a knitted element having overlapping portions such as a CNC knitting machine. The knitted element 20 includes a toe end 22 and a heel end 24. When assembled into the shoe 10, the toe end 22 is opposite the heel end 24. The toe end 22 and heel end 24 may not be coextensive with the toe end 19 of the overall shoe 10 and the heel end 18 of the overall shoe 10, respectively. Before assembly into the shoe 10, the knitted element 20 includes both the toe end 22 and the heel end 24 but may not terminate at either end (e.g., as shown in FIGS. 4 and 5). Knitting the knitted element 20 in this manner facilitates knitting of the features described herein and facilitates assembly of the knitted element 20 into shoe 10.

The knitted element 20 includes a heel region 26, a lateral quarter region 28, a medial quarter region 30, a lateral midfoot region 32, a medial midfoot region 34, a lateral ball region 36, a medial ball region 38, a lateral metatarsal region 40, a medial metatarsal region 42, a toe region 44, a tongue region 46, and a collar region 48. Each region is seamlessly knitted with adjacent regions, as the knitted element 20 is of unitary one-piece construction.

With the knitted element 20 assembled into the shoe 10, the heel region 26 extends longitudinally from the heel end 24 to the lateral quarter region 28 and the medial quarter region 30. The lateral quarter region 28 and the medial quarter region 30 extend longitudinally from the heel region 26 to the lateral midfoot region 32 and the medial midfoot region 34, respectively. The lateral midfoot region 32 and the medial midfoot region 34 extend longitudinally from the lateral quarter region 28 and the medial quarter region 30 to the lateral ball region 36 and the medial ball 38 region, respectively. The lateral ball region 36 and the medial ball region 38 extend longitudinally from the lateral midfoot region 32 and the medial midfoot region 34 to the lateral metatarsal region 40 and the medial metatarsal region 42, respectively. The lateral metatarsal region 40 and the medial metatarsal region 42 extend longitudinally from the lateral ball region 36 and the medial ball region 38 to the toe region 44. The toe region 44 extends longitudinally from the lateral metatarsal region 40 and the medial metatarsal region 42 to the toe end 22. The toe region 44 also extends laterally between the lateral and medial sides of the knitted element 20. The tongue region extends upwardly and laterally from both the lateral ball region 36 and the medial ball region 38. The tongue region also extends upwardly and laterally from the lateral metatarsal region 40 and the medial metatarsal region 42. The collar region 48 extends upwardly from the heel region 26, lateral and medial quarter regions 28, 30, and the lateral and medial midfoot regions 32, 34.

The knitted element 20 includes a Moc seam allowance of additional material within the toe region 44, lateral metatarsal region 40, the medial metatarsal region 42, the lateral ball region 36, and the medial ball region 38. The Moc seam allowance is best seen in FIG. 5 and is identified with reference numeral 49. The Moc seam allowance 49 of additional material provides for the material used to construct a Moc seam in the shoe 10. The Moc seam allowance 49 of additional material thus provides for the material making up a Moc seam while maintaining the unitary one-piece construction of the knitted element 20. This is in contrast to a shoe having a multipart construction in which a Moc seam could be formed without using a Moc seam allowance as the Moc seam would be formed by joining two or more separate textiles together. In some embodiments, the Moc seam allowance of additional material is also present in the lateral midfoot region 32 and the medial midfoot region 34.

Figure 6:
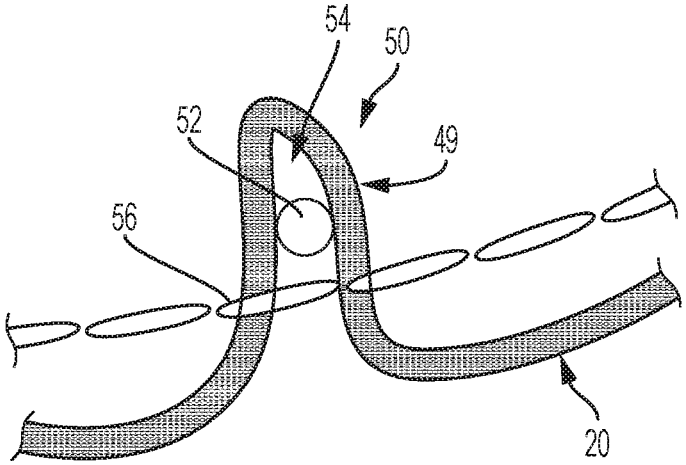
FIG. 6 is a cross-sectional view of a portion of the shoe of FIG. 1 taken along the line 6-6.

The upper 14 includes a Moc seam 50. The Moc seam 50 is formed in part by the knitted element 20. The seam includes a core 52 around which the knitted element 20 extends. The core 52 gives, in part, shape to the Moc seam 50. The Moc seam allowance 49 of additional material in the knitted element 20 is wrapped around the core 52 and is stitched to itself to contain the core 52 at least partially within a cavity 54 formed by the Moc seam allowance 49. This is best illustrated with reference to FIG. 6. Stitches 56 secure the core 52 within the knitted element 20. The Moc seam allowance 49 of additional material is only partially wrapped around the core 52 and does not enclose the core 52. The allowance 49 is stitched to itself such that the stitching 56 secures the core 52 to and within the allowance 49. In other regions of the upper 14 or in alternative embodiments, the Moc seam allowance 49 of additional material in the knitted element 20 is wrapped entirely around the core 52 such that the core 52 is enclosed within the allowance 49 of additional material. For example, and without limitation, the allowance 49 of additional material in the knitted element 20 is wrapped entirely around the core 52 in the toe region 44 and the allowance 49 of additional material in the knitted element 20 is wrapped only partially around the core 52 in the lateral metatarsal and medial metatarsal regions 40, 42.

The core 52 has a circular cross section. This shape gives the Moc seam 50 a partially circular cross section. In alternative embodiments, the core 52 is shaped with alternative cross sections to provide the Moc seam 50 with alternative shapes. The core 52 is mode of any suitable material. For example, and without limitation, the core 52 is made from one or more of rubber, plastic, natural fibers, chording, or another suitable material. The core 52 may be made from a material and shaped such that the core 52 resiliently retains the shape of the Moc seam 50. For example, and without limitation, the core 52 may be made of a plastic or polymer and shaped in a U shape to resiliently maintain the shape of the Moc seam 50 and/or the shape of the shoe 10 in the toe region 44, lateral and medial metatarsal regions 40, 42, lateral and medial ball regions 36, 38, and/or the throat region 46.

The Moc seam 50, including the core 52, extends from a first end 58 to an apex 60 and from the apex 60 to a second end 62. The first end 58 is in the medial ball region 38 and being adjacent the throat region 46. The second end 62 is in the lateral ball region 36 and being adjacent the throat region 46. The apex is in the toe region 44. For example, and without limitation, the core 52 and/or the Moc seam 50 may terminate at a penny keeper 64 or other feature that is aligned with or in the lateral and medial ball regions 36, 38. The penny keeper 64 is typically constructed of a different material than the knit element 20. For example, and without limitation, the penny keeper 64 may be leather, imitation leather, plastic, or any other suitable material.

In some embodiments, the Moc seam 50 also extends into the lateral midfoot region 32 and the medial midfoot region 43. The core 52 may or may not be present in the lateral midfoot region 32 and the medial midfoot region 34. For example, and without limitation, the Moc seam allowance 49 is stitched to itself in the lateral midfoot region 32 and the medial midfoot region 34 to form a cavity, but the core 52 terminates before reaching the lateral midfoot region 32 and the medial midfoot region 34. The stitching of the Moc seam allowance 49 to itself provides the structure of the Moc seam 50 within the lateral midfoot region 32 and the medial midfoot region 34.

It should be understood that the Moc seam 50, as described herein, is not a "seam" joining two separate textile pieces. The Moc seam 50 is rather an integrated part formed in the knitted element 20, with the Moc seam 50 being formed from the knitted element 20 and the core 52. As discussed above, the knitted element 20 maintains a unitary one-piece construction with the Moc seam 50 being formed therein.

The shoe 10 also includes a butt seam 66. The butt seam 66 is within the heel region 26. The butt seam 66 is formed in the same manner as the Moc seam 50. The knitted element 20 includes a butt seam allowance 68 of additional material within the heel region 26. The butt seam allowance 68 is wrapped around a second core (not shown) and stitched to itself to form the butt seam 66.

The construction of the Moc seam 50 and the butt seam 66 as described herein allows for the shoe 10 to have one or more pronounced seams while maintaining a unitary one-piece construction.

The shoe 10 also includes a collar 70 within the collar region 48. The collar 70 is formed from the knitted element 20. The collar 70 is the knitted element 20 folded over onto itself and stitched to itself such that the knitted element 20 is two layers within the collar region 48 and the collar 70 is within the collar region 48. To facilitate this construction, the knitted element 20 includes a collar margin 72. The collar margin 72 is coextensive with the collar region 48, but before the knitted element is folded to form the collar 70, the collar margin 72 overlaps a portion of the one or more of the lateral midfoot region 32 and the medial midfoot region 34. This is best illustrated with reference to FIG. 5, the overlapping portion being identified with reference numeral 76. Once the collar margin 72 is folded over and onto itself, an end portion 74 of the collar margin 72 is stitched to the collar margin 72 opposite in the collar region 48 and opposite the fold to form the double layer collar 70. The collar margin 72 then overlaps only itself and only overlaps in the collar region 48. The overlap portion 76 allows for the formation of the double layered collar 70 while maintaining the unitary one piece construction of the knit element 20 which forms the upper 14. To knit the knitted element 20 with the overlap portion 76, special techniques are used. For example, and without limitation, a CNC knitting machine or other suitable machines and/or techniques may be used to knit the knitted element 20 with the overlap portion 76.

The collar 70 extends longitudinally within the lateral midfoot region 32, the lateral quarter region 28, the heel region 26, the medial quarter region 30, and the medial midfoot region 34. The collar 70 is also continuous within the lateral midfoot region, the lateral midfoot region 32, the lateral quarter region 28, the heel region 26, the medial quarter region 30, and the medial midfoot region 34.

The knitted element 20 having the features described herein may be knitted with one or more yarns, such as polyester yarns, nylon yarns, cotton yarns, and spandex yarns. In one embodiment, the knitted element 20 is knitted of polyester covered spandex yarn and hot melt yarn, such that of the finished knitted element, the polyester covered spandex yarn constitutes at least 50% by mass (and more preferably at least 60% by mass), and the hot melt yarn constitutes at least 15% by mass (and more preferably at least 20% by mass but not more than 30% by mass). The hot melt yarn is knitted with the polyester covered spandex yarn during the knitting process. Preferably, the polyester covered spandex yarn has a linear density of between about 120 denier and about 180 denier, and the hot melt yarn has a linear density of between about 80 denier and about 120 denier. In addition to the polyester covered spandex yarn and the hot melt yarn, the knitted element 20 may be knitted with stretch yarn, with the stretch yarn preferably constituting at least 5% by mass of the knitted upper. If stretch yarn is included, it is preferably limited (but need not be limited) to the topline area of the knitted element 20 to provide a stretch function primarily in the ankle region of the upper 14 of the shoe 10. Preferably, the polyester covered spandex yarn includes a double layer of polyester. Also preferably, the stretch yarn is spandex yarn. In another embodiment, the knitted element 20 is formed by knitting hot melt yarn with polyester yarn during the knitting process such that polyester yarn constitutes at least 50% by mass of the knitted element and the hot melt yarn constitutes at least 15% by mass of the knitted element.

The shoe 10 may be manufactured using the following described method or any other suitable method. The method includes knitting a one-piece knitted element 20 having a unitary one-piece construction using a flat knitting machine. The resulting knitted element 20 having the features described herein is illustrated schematically by FIG. 6. The knitted element 20 is knitted to have a top side 78 and a bottom side 80. The knitted element 20 resulting from the knitting step has a toe end 22, a heel region 26, a lateral quarter region 28, a medial quarter region 30, a lateral midfoot region 32, a medial midfoot region 34, a lateral ball region 36, a medial ball region 38, a lateral metatarsal region 40, a medial metatarsal region 42, a toe region 44, a tongue region, 46 and a collar region 48, all of the type described herein. The collar region 48 includes the collar margin 72. Each region is knitted during the knitting step such that the toe region 44 extends longitudinally from the toe end 22. The lateral and medial metatarsal regions 40, 42 extend laterally and longitudinally from the toe region 22. The lateral and medial ball regions 32, 34 extend longitudinally and laterally from the lateral and medial metatarsal regions 40, 42 respectively. The lateral midfoot region 32 extends longitudinally from the lateral ball region 36. The lateral quarter region 28 extends longitudinally from the lateral midfoot region 32. The heel region 26 extends longitudinally from the lateral quarter region. The medial quarter region 30 extends longitudinally from the heel region 26. At least a portion of the medial midfoot region 34 extends longitudinally from the medial quarter region and extends to a free end 82 opposite the toe end 22. In some embodiments, a portion of the medial midfoot region also extends longitudinally from the medial ball region 38. The collar region 48 extends laterally from the heel region 26, lateral and medial quarter regions 28, 30, and the lateral and medial midfoot regions 32, 34. The free end 82 and relatively flat construction of the knitted element 20 resulting from the knitting step allows for the formation of the collar 70 and/or other features of the shoe 10. It should be noted that the knitted element 20 may be knit such that the free end 82 is any of the described regions. The location of the free end 82 determines at which point the knitted element 20 is stitched together to complete/close the upper 14.

The knitting step also includes knitting the knitted element 20 with the Moc seam allowance 49, butt seam allowance 68, and the overlap portion 76. The overlap portion 76 of the knitted element is positioned underneath a portion of the lateral midfoot region 32 and/or the tongue region 46. The Moc seam allowance 49 of additional material is knitted into the toe region 44, the lateral and medial metatarsal regions 40, 42, and the lateral and medial ball regions 36, 38. The butt seam allowance 68 of additional material is knitted into the heel region 26.

The method of constructing the shoe 10 further includes forming the Moc seam 50 by positioning the core 52 in contact with the knitted element 20 adjacent the Moc seam allowance 49. The step continues by drawing the Moc seam allowance 49 at least partially around the core 52. The Moc seam 50 is completed by stitching the Moc seam allowance 49 to itself such that the core 52 is contained at least partially within the cavity 54 and such that the Moc seam 50 is formed in the knitted element 20. The same steps may be repeated in the heel region 26 with the butt seam allowance 68 and a second core to form the butt seam 66. The knitted element 20 having the Moc seam 50 and the butt seam 66 is illustrated in FIG. 4.

The method further includes constructing the collar 70 by folding the collar region 48 (e.g., the collar margin 72) over and onto itself to place the collar region 48 in a double layer configuration. In the double layer configuration, a portion of the top side 78 of the collar region 48 is in contact with another portion of the top side 78 of the collar region, and a portion of the bottom side 80 of the collar region 48 is on top. This is best shown in FIGS. 4 and 5, with FIG. 5 showing the bottom side 80 of the collar region 48 on top (e.g., facing outward when knitted element 20 is assembled into the shoe 10). Forming the collar 70 continues with stitching the folded collar region 48 to itself to secure the collar region 48 in the double layered configuration such that the collar region does not overlap at least the tongue region 46. The collar region 48 is stitched such that the collar region 48 also does not overlap the lateral midfoot region 32 and the medial midfoot region 34. The overlap portion 76 no longer overlaps either midfoot region once the collar 70 is stitched in place. As previously described, the overlap portion 76 allows for a unitary once-piece construction of the upper 14 while allowing the collar 70 to be double layered throughout. This technique makes use of the ability to knit in multiple layers.

The method of constructing the shoe 10 further includes stitching the knitted element to itself to complete/close the upper 14. This includes stitching the free end 82 of the knitted element 20 to the knitted element after forming the upper. For example, and without limitation, the free end 82 is stitched to the knitted element 20 such that the two portions of the medial midfoot region 34 are joined. As explained herein, the free end 82 may be located in any region and this step adjusting to complete/close the upper 14. The method of constructing the shoe 10 further includes securing the upper 14 to the sole 12. For example, and without limitation, the knitted element is stitched to or glued to the sole 12. The method of constructing the shoe 10 further includes stitching the penny keeper 64 to the knitted element 20 in one or more of the throat region 46, lateral ball region 36, lateral midfoot region 32, medial ball region 38, and the medial midfoot region 34. This positions the penny keeper 64 such that it crosses the upper 14 laterally and is positioned over at least a portion of the throat region 46. In some embodiments, the penny keeper 64 is not stitched to the knitted element 20 in the throat region 46.

In view of the foregoing, it should be appreciated that the shoe of the disclosure has several advantages over the prior art.

As various modifications could be made in the constructions and methods herein described and illustrated without departing from the scope of the disclosure, it is intended that all matter contained in the foregoing description or shown in the accompanying drawings shall be interpreted as illustrative rather than limiting. For example, the wedge shoe may be any type of wedge shoe, such as a wedge sandal, a wedge pump, an open-toe wedge, a platform wedge, etc. Thus, the breadth and scope of the present disclosure should not be limited by any of the above-described exemplary embodiments, but should be defined only in accordance with the following claims appended hereto and their equivalents It should also be understood that when introducing elements in the present disclosure in the claims or in the above description of exemplary embodiments of the disclosure, the terms "comprising," "including," and "having" are intended to be open-ended and mean that there may be additional elements other than the listed elements. Additionally, the term "portion" should be construed as meaning some or all of the item or element that it qualifies. Moreover, use of identifiers such as first, second, and third should not be construed in a manner imposing any relative position or time sequence between limitations.

What is claimed is:

1. A shoe comprising:

a sole;

an upper secured to the sole, the upper having a knitted element being formed of a unitary one-piece construction during a knitting process on a knitting machine, the knitted element having a toe end, a heel end, a heel region, a lateral quarter region, a medial quarter region, a lateral midfoot region, a medial midfoot region, a lateral ball region, a medial ball region, a lateral metatarsal region, a medial metatarsal region, a toe region, a tongue region, and a collar region, the heel region extending longitudinally from the heel end to the lateral and medial quarter regions, the lateral and medial quarter regions extending longitudinally from the heel region to the lateral and medial midfoot regions respectively, the lateral and medial midfoot regions extending longitudinally from the lateral and medial quarter regions to the lateral and medial ball regions respectively, the lateral and medial ball regions extending longitudinally from the lateral and medial midfoot regions to the lateral and medial metatarsal regions respectively, the lateral and medial metatarsal regions extending longitudinally from the lateral and medial ball regions to the toe region, the toe region extending longitudinally from the lateral and medial metatarsal regions to the toe end, the tongue region extending upwardly and laterally from both the lateral and medial ball regions, the collar region extending upwardly from the heel region, lateral and medial quarter regions, and the lateral and medial midfoot regions, the knitted element defining an opening in the collar region, the opening adapted and configured to receive a foot, the knitted element including a Moc seam allowance of additional material within the toe region, lateral and medial metatarsal regions, and the lateral and medial ball regions, the upper further having a Moc seam formed in part by the knitted element, the Moc seam being in at least the toe region, the lateral metatarsal region, and the medial metatarsal region, the Moc seam comprising a core around which the Moc seam allowance of additional material in the knitted element is wrapped and stitched to itself to contain the core at least partially within a cavity formed by the Moc seam allowance of additional material.

2. A shoe in accordance with claim 1 wherein the allowance of additional material in the knitted element is wrapped entirely around the core such that the core is enclosed within the allowance of additional material.

3. A shoe in accordance with claim 1 wherein the allowance of additional material is only partially wrapped around the core and does not enclose the core, the allowance of additional material being stitched to itself such that the stitching secures the core to the allowance of additional material.

4. A shoe in accordance with claim 1 wherein the allowance of additional material in the knitted element is wrapped entirely around the core in the toe region and the allowance of additional material in the knitted element is wrapped only partially around the core in the lateral metatarsal and medial metatarsal regions.

5. A shoe in accordance with claim 1 wherein the core has a circular cross section and wherein the Moc seam is partially circular in cross section.

6. A shoe in accordance with claim 1, wherein the Moc seam, including the core, extends from a first end to an apex and from the apex to a second end, the first end being in the medial ball region and being adjacent the throat region, the second end being in the lateral ball region and being adjacent the throat region, the apex being in the toe region.

7. A shoe in accordance with claim 1, the knitted element being folded over onto itself and stitched to itself such that the knitted element is two layers within the collar region and forms the collar within the collar region.

8. A shoe in accordance with claim 7 wherein the knitted element comprises an overlap portion, and the knitted element extends within the collar region such that:

if the knitted element were unfolded to be one layer within the collar region, then the overlap portion of the knitted element would overlap a portion of one or more of the lateral midfoot region, the medial midfoot region, and the tongue region.

9. A shoe in accordance with claim 1, the knitted element further comprising a butt seam allowance of additional material and the upper further comprising a butt seam, the butt seam allowance of additional material being within the heel region of the knitted element, the butt seam comprising a second core.

10. A shoe in accordance with claim 1 further comprising a penny keeper, the penny keeper coupled to the knitted element in the lateral and medial ball regions, the penny keeper overlying the tongue region of the knitted element, the penny keeper being of a different material than the upper.

11. A shoe comprising:

a sole;

an upper secured to the sole, the upper having a knitted element being formed of a unitary one-piece construction during a knitting process on a knitting machine, the knitted element having a toe end, a heel end, a heel region, a lateral quarter region, a medial quarter region, a lateral midfoot region, a medial midfoot region, a lateral ball region, a medial ball region, a lateral metatarsal region, a medial metatarsal region, a toe region, a tongue region, and a collar region, the heel region extending longitudinally from the heel end to the lateral and medial quarter regions, the lateral and medial quarter regions extending longitudinal from the heel region to the lateral and medial midfoot regions respectively, the lateral and medial midfoot regions extending longitudinally from the lateral and medial quarter regions to the lateral and medial ball regions respectively, the lateral and medial ball regions extending longitudinally from the lateral and medial midfoot regions to the lateral and medial metatarsal regions respectively, the lateral and medial metatarsal regions extending longitudinally from the lateral and medial ball regions to the toe region, the toe region extending longitudinally from the lateral and medial metatarsal regions to the toe end, the tongue region extending upwardly and laterally from both the lateral and medial ball regions, the collar region extending upwardly from the heel region, lateral and medial quarter regions, and the lateral and medial midfoot regions, the knitted element defining an opening in the collar region, the opening adapted and configured to receive a foot, the knitted element forming a collar in the collar region, the collar comprising a portion of the knitted element being folded over onto itself and stitched to itself to form two layers within the collar region, wherein the knitted element comprises an overlap portion, and the knitted element extends within the collar region such that:

if the knitted element were unfolded to be one layer within the collar region, then the overlap portion of the knitted element would overlap a portion of one or more of the lateral midfoot region, the medial midfoot region, and the tongue region.

12. A shoe in accordance with claim 11 wherein the collar extends longitudinally within the lateral midfoot region, the lateral quarter region, the heel region, the medial quarter region, and the medial midfoot region.

13. A shoe in accordance with claim 12 wherein the collar is continuous within the lateral midfoot region, the lateral quarter region, the heel region, the medial quarter region, and the medial midfoot region.

14. A shoe in accordance with claim 11 further comprising a penny keeper, the penny keeper coupled to the knitted element in the lateral and medial ball regions, the penny keeper overlying the tongue region of the knitted element, the penny keeper being of a different material than the upper.

15. A shoe in accordance with claim 11, the knitted element including a Moc seam allowance of additional material within the toe region, lateral and medial metatarsal regions, and the lateral and medial ball regions, the upper having a Moc seam formed in part by the knitted element, the Moc seam being in at least the toe region, the lateral metatarsal region, and the medial metatarsal region, the Moc seam comprising a core around which the Moc seam allowance of additional material in the knitted element is wrapped and stitched to itself to contain the core at least partially within a cavity formed by the Moc seam allowance of additional material.

* * * * *